US007730577B2

(12) United States Patent
Wood

(10) Patent No.: US 7,730,577 B2
(45) Date of Patent: Jun. 8, 2010

(54) CONTROL HANDLE ASSEMBLY

(75) Inventor: David W. Wood, Maple Plain, MN (US)

(73) Assignee: Nilfisk-Advance, Inc., Plymouth, MN (US)

( * ) Notice: Subject to any disclaimer, the term of this patent is extended or adjusted under 35 U.S.C. 154(b) by 1236 days.

(21) Appl. No.: 11/281,336

(22) Filed: Nov. 17, 2005

(65) Prior Publication Data

US 2006/0101613 A1 May 18, 2006

Related U.S. Application Data

(60) Provisional application No. 60/628,589, filed on Nov. 17, 2004.

(51) Int. Cl.
*A47L 9/00* (2006.01)
*E01H 1/08* (2006.01)

(52) U.S. Cl. ..... 15/410; 15/340.1

(58) Field of Classification Search ..... 15/340.1–340.4, 15/410; *A47L 9/00; E01H 1/08*
See application file for complete search history.

(56) References Cited

U.S. PATENT DOCUMENTS

| | | | | |
|---|---|---|---|---|
| 4,132,280 | A | 1/1979 | Jones et al. | 180/19 H |
| D295,865 | S | 5/1988 | Rosenblad | D15/18 |
| 4,882,897 | A | 11/1989 | Oshima et al. | 56/11.3 |
| 5,146,735 | A | 9/1992 | McDonner | 56/11.3 |
| 5,343,678 | A | 9/1994 | Stuart | 56/11.3 |
| 5,829,095 | A | 11/1998 | Legatt et al. | 15/412 |
| D424,578 | S | 5/2000 | Friberg et al. | D15/18 |
| 6,148,476 | A | 11/2000 | Legatt et al. | 15/385 |
| 6,324,728 | B1 | 12/2001 | Blankenheim | 16/431 |
| 6,427,285 | B1 | 8/2002 | Legatt et al. | 15/320 |
| 6,640,526 | B2 | 11/2003 | Velke et al. | 56/10.8 |
| 6,666,008 | B2 | 12/2003 | Iida et al. | 56/11.9 |
| D489,734 | S | 5/2004 | Lin | D15/14 |

*Primary Examiner*—David A Redding
(74) *Attorney, Agent, or Firm*—Alan Kamrath; Kamrath & Associates PA

(57) ABSTRACT

A control handle assembly (200) includes a rigid handle (202) for grasping by the operator to steer a walk-behind mobile machine (10) and a control portion (220) moveable relative to the handle (202) to control a function of the machine (10). A flexible extension (238) extends between the handle (202) and the control portion (220) and over the separation defined thereby. The flexible extension (238) flexes when pushed or pulled by the operator's hands and particularly when the flexible extension is engaged with both the control portion (220) and the handle (202) and when the operator's hand extends into the separation therebetween.

20 Claims, 3 Drawing Sheets

CONTROL HANDLE ASSEMBLY

CROSS REFERENCE

The present application claims the benefit of U.S. Provisional Appln. No. 60/628,589 filed on Nov. 17, 2004.

BACKGROUND

The present invention generally relates to a control handle assembly for a walk-behind mobile vehicle or machine, particularly to a handle assembly including a fixed handle for steering the mobile vehicle or machine and a control portion moveable relative to the handle for controlling an operative function of the mobile vehicle or machine, and specifically to a handle assembly including a flexible extension extending between the fixed handle and the moveable control portion and over the separation therebetween.

In walk-behind mobile vehicles or machines, an operator grips a handle for steering the vehicle or machine and simultaneously must control an operative function of the mobile vehicle or machine. As an example, in the case of floor scrubbers, the speed at which the floor scrubber traverses the floor is desired to be adjusted during operation to slow the floor scrubber at heavy soiled areas requiring more aggressive scrubbing and to increase the speed of the floor scrubber at lesser soiled areas where minimal scrubbing is needed. Floor scrubbers include solution and recovery tanks full of cleaning and recovered solutions and often include batteries as a source of power such that they are relatively heavy which increases the steering difficulty. Additionally, the scrubbing member or the like of the floor scrubber may tend to force the floor scrubber in unintended directions in normal operation. Thus, it is necessary for the operator to tightly grip the handle to steer the floor scrubber while simultaneously moving a switch portion to control the speed of the floor scrubber. Typically, the switch portion is operated by the thumb(s) of the operator while the handle is being gripped and steered by the user's hands. Thus, the hands and especially the thumbs of the operator become quickly fatigued.

Similar problems may occur in other types and forms of walk-behind mobile vehicles or machines. Thus, a need exists for a handle assembly allowing simultaneous steering and function control which does not result in operator fatigue, which overcomes other problems and deficiencies in prior handle assemblies, and which is otherwise advantageous over prior handle assemblies for walk-behind mobile vehicles or machines.

SUMMARY

The present invention solves this need and other problems in the field of handle assemblies for walk-behind mobile vehicles or machines by providing a rigid handle held in a stationary position relative to the vehicle or machine and graspable by the operator's hands for steering. A control portion controlling an operative function of the vehicle or machine is moveable relative to the handle by the hand(s) of the operator gripping the handle. A flexible extension extends between the handle and the control portion and over the separation therebetween. Flexing of the flexible extensions prevents pinching of the operator's hand as a result of movement of the control portion relative to the handle, results in less operator fatigue, and/or overcomes other deficiencies of prior handle assemblies.

A preferred embodiment according to the teachings of the present invention utilizes a U-shaped extension attached to a hollow control portion pivotally mounted to a switch bar extending between grip bars arranged in an inverted U-shape. It should be appreciated that the teachings of the present invention could be applied to other forms and types of handles and control portions currently in existence or which are developed hereafter.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
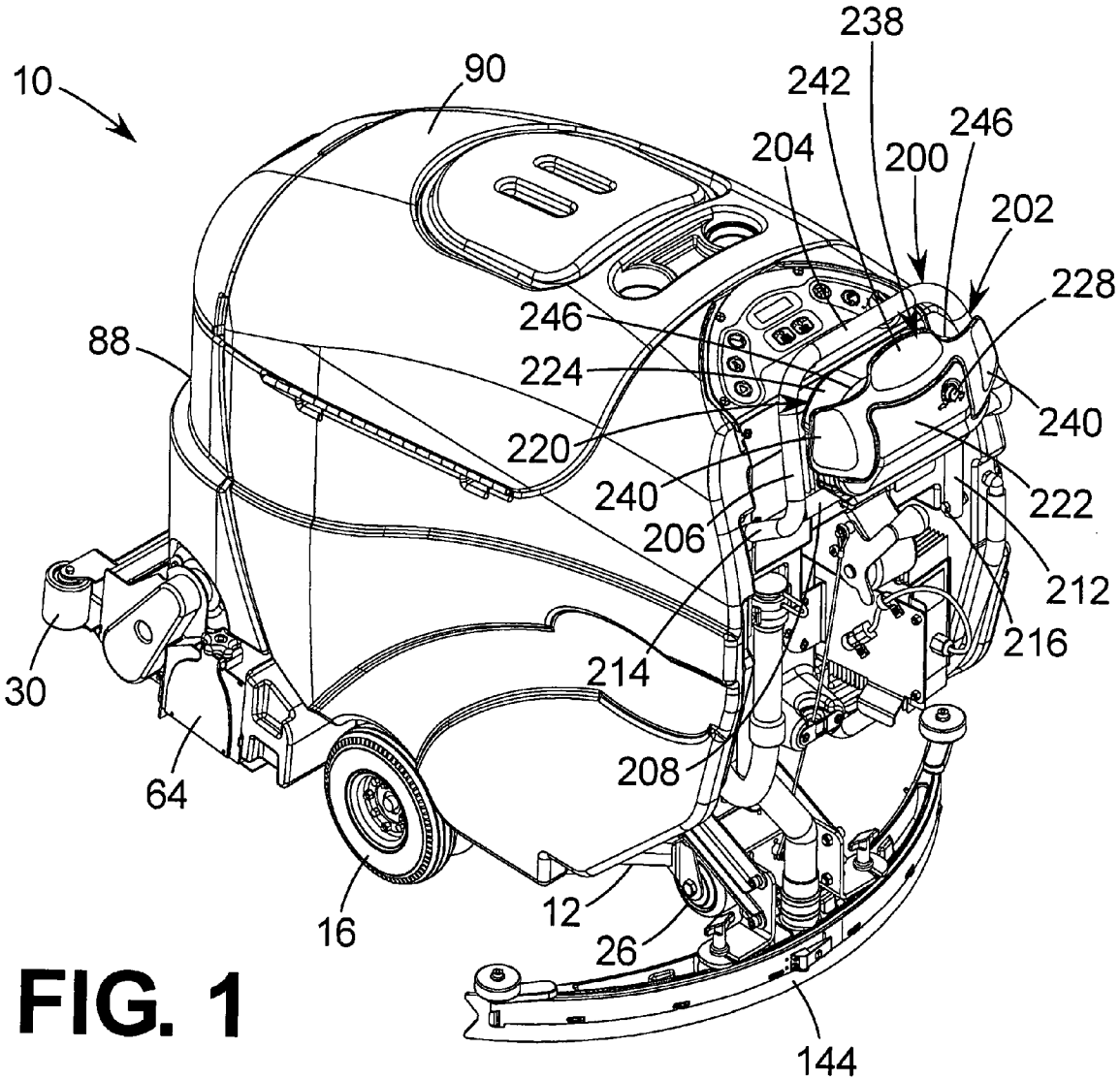
FIG. 1 shows a perspective view of a walk-behind vehicle or machine in the preferred form of a floor scrubber and including a control handle assembly according to the preferred teachings of the present invention.
Figure 2:
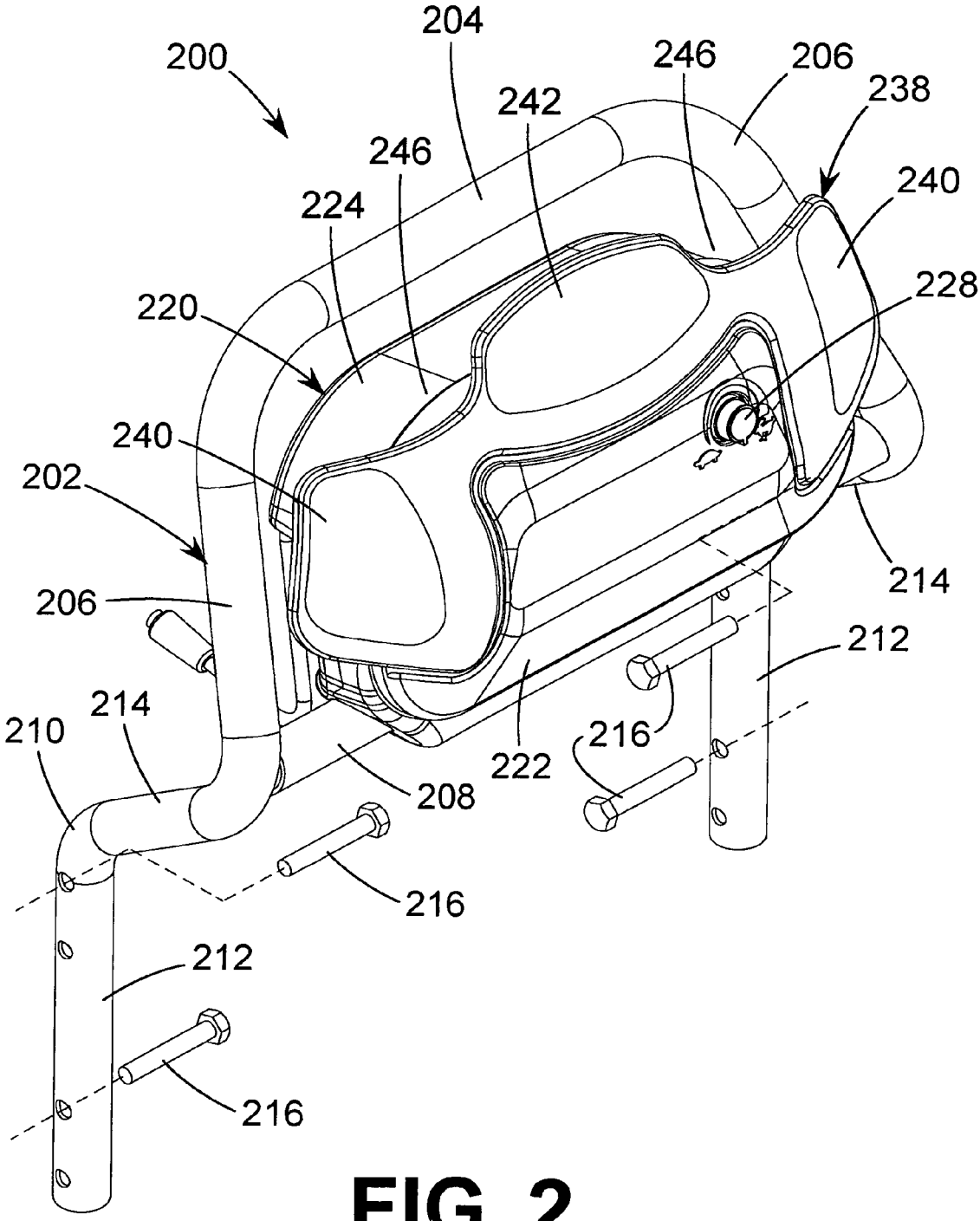
FIG. 2 shows an exploded perspective view of the control handle assembly of FIG. 1.

All figures are drawn for ease of explanation of the basic teachings of the present invention only; the extensions of the figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "top", "bottom", "first", "second", "forward", "rearward", "reverse", "front", "back", "height", "width", "length", "end", "side", "horizontal", "vertical", and similar terms are used herein, it should be understood that these terms have reference only to the structure shown in the drawings as it would appear to a person viewing the drawings and are utilized only to facilitate describing the illustrative embodiment.

DESCRIPTION OF THE EMBODIMENTS

A control handle assembly for a walk-behind mobile vehicle or machine is shown in the drawings and generally designated 200. In the most preferred form, handle assembly 200 is being utilized in a floor scrubber 10 generally of the type shown and described in U.S. Pat. Nos. 5,829,095; 6,148,476 and 6,427,285, which are hereby incorporated by reference. The description of the common numerals and floor scrubber 10 may be found herein and in U.S. Pat. Nos. 5,829,095; 6,148,476 and 6,427,285.

Floor scrubber 10 generally includes a chassis 12 having a pair of wheels 16 and at least one caster 26 mounted thereto for rotation about a horizontal axis. In the preferred form, wheels 16 are driven by an electric motor(s) powered by batteries carried by chassis 12. However, it should be appreciated that wheels 16 and/or caster 26 providing mobility of chassis 12 on the floor can take a variety of forms, types and arrangements, with wheels 16 and caster 26 being only exemplary. Chassis 12 further mounts a scrubbing member 64 which is shown as being of the cylindrical brush type. Scrubbing member 64 can take a variety of forms, types and arrangements including but not limited to disk brush types shown in U.S. Pat. Nos. 5,829,095; 6,148,476 and 6,427,285. A bumper wheel 30 is carried by chassis 12 for engaging obstacles and for forcing floor scrubber 10 to move away therefrom. Scrubber 10 includes a solution tank 88 mounted on chassis 12 for holding cleaning solution which can be supplied to or adjacent the scrubbing member 64. Scrubber 10 further includes provisions 144 such as a squeegee as shown for picking up solution from the floor surface for delivery to a recovery tank 90 in the preferred form mounted on top of the solution tank 88.

Handle assembly 200 is located at the rear of floor scrubber 10 and in the preferred form includes a rigid handle 202 which is held in a stationary position fixed relative to chassis 12. In the form shown, handle 202 has a general isosceles trapezoid portion including a horizontal grip bar 204, first (left) and second (right) vertical grip bars 206, and a horizontal switch bar 208 parallel to and spaced below the horizontal grip 204. Vertical grip bars 206 extend at acute angles from switch bar 208 and at obtuse angles from grip bar 204 such that grip bar 204 has a shorter length than switch bar 208. Thus, the operator has a variety of choices of how to grasp rigid handle 202 such as grasping grip bars 206 by the right and left hands, by grasping grip bar 204 by one or both hands, by grasping handle 202 at the corners between bar 204 and bars 206 with one or both hands, or the like.

Handle 202 is mounted to the chassis 12 by an suitable manner such that in the preferred form shown at least grip bars 204 and 206 are spaced from other portions of the floor scrubber 10 in a manner to allow an operator's hand to grip bars 204 and 206 with the fingers wrapped generally concentrically therearound. Specifically, in the preferred form, first and second boomerang-shaped mounts 210 are provided each including a first leg 212 and a second leg 214 extending at an obtuse angle from the first leg 212. First legs 212 are secured to chassis 12 in a spaced, generally vertical manner such as by bolts 216 extending through apertures in first legs 212 and threaded into chassis 12 or a component carried by chassis 12. In the most preferred form, bolts 216 can be threaded into chassis 12 or a component carried thereby at differing vertical locations such that handle 202 can be positioned at a height that is comfortable for an operator of average height in the region where vehicle or machine 10 is being marketed or for particular operator preferences. Second legs 214 extend slightly upward rearward of scrubber 10. Grip bars 206 extend at an obtuse angle from second legs 214. Thus, in the preferred form, grip bar 204 is slightly forward of horizontal switch bar 208 such that handle 202 and vertical grip bars 206 tilt forward at an angle in the order of 25° from the vertical away from an operator gripping handle 202 during operation. In the most preferred form, handle 202 including bars 204, 206 and 208 and mounts 210 have round cross-sections that can be easily gripped by an operator and in the most preferred form is formed from 1 inch (2.5 cm) steel tubing. The interconnections between grip bars 204 and 206 are radiused and in the most preferred form are radiused along arcs having a radius in the order of 3 times the diameter of bars 204 and 206 and particularly in the order of 3 to 4 inches (7.6 to 10.2 cm) in the preferred form. However, it is contemplated that other manners of attaching handle 202 of the type shown and described or of other types and forms can be utilized with the teachings of the present invention.

Handle assembly 200 according to the teachings of the present invention includes a control portion 220 movably mounted relative to handle 202. In the preferred form, control portion 220 is pivotally mounted relative to chassis 12, and in the most preferred form is pivotally mounted on handle 202. In the preferred form shown, control portion 220 includes a rear housing 222 and a front housing 224 secured together to define a hollow interior. In the preferred form, housings 222 and 224 include or define suitable provisions pivotally mounting housing 222 and 224 on switch bar 208. Housings 222 and 224 are spaced from vertical grip bars 206 and horizontal grip bar 204 and in the most preferred form are spaced to form a U-shaped gap having a width of 1½ in. (3.81 cm) from each of bars 204 and 206.

Figures 3, 4, 5:
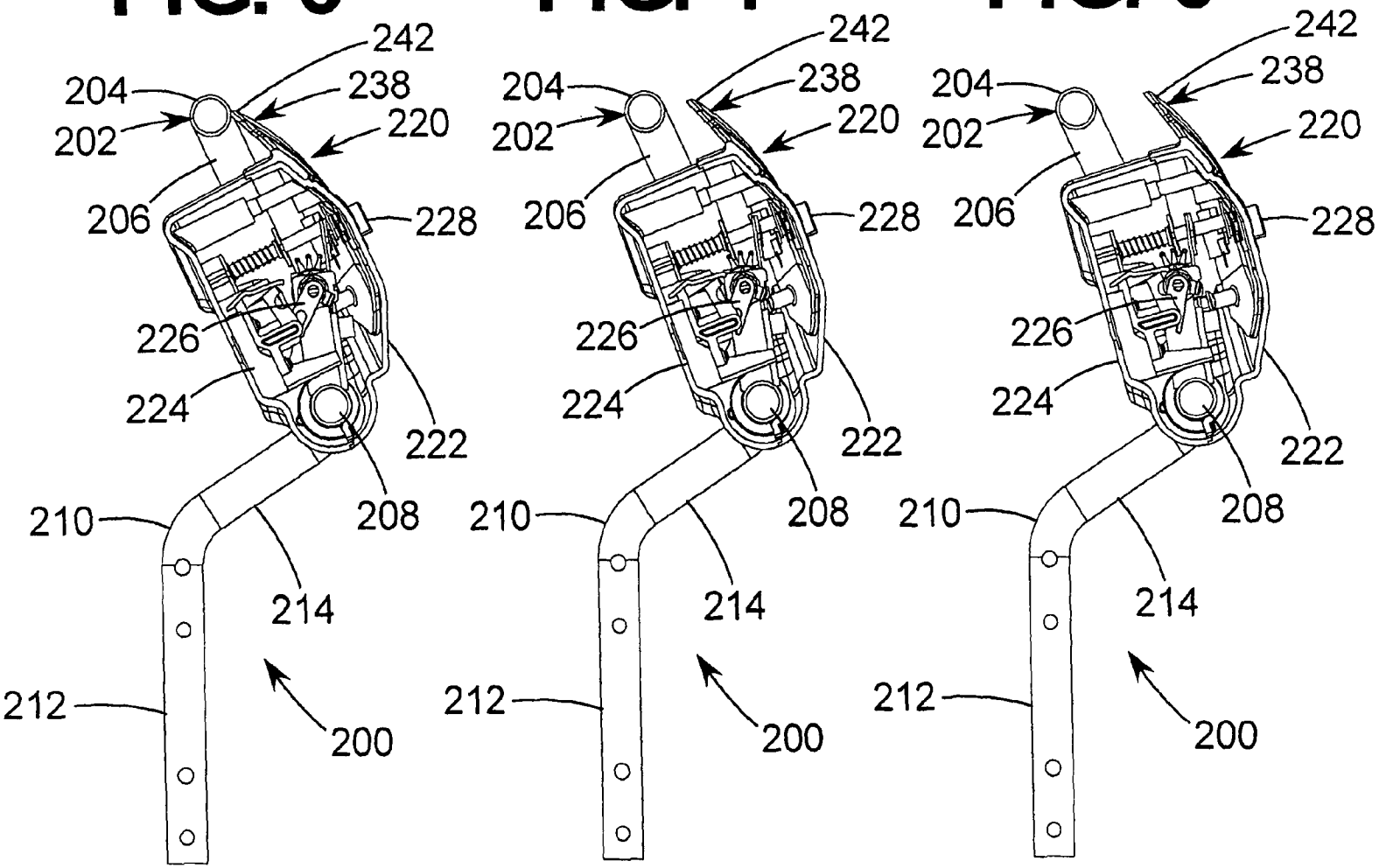
FIGS. 3-5 show cross sectional views of the control handle assembly of FIG. 1 in forward, neutral and reverse positions, respectively.

Control portion 220 of the most preferred form further includes a variable switch 226 located inside of the interior of housings 222 and 224. In particular, switch 226 provides a variable signal according to the position of housings 222 and 224 relative to handle 202 and chassis 12 and in the preferred form provides electrical communication with an electronic speed controller for the electric motor driving wheels 16. In the preferred form, switch 226 has a center neutral position as shown in FIG. 4, a forward position as shown in FIG. 3 pivoted forward of the neutral position, and a reverse position as shown in FIG. 5 pivoted rearward of the neutral position. In the most preferred form, the forward and reverse positions are defined by physical stops fixed to switch bar 208 and against which control portion 220 abuts.

Control portion 220 controls an operative function of the walk-behind mobile vehicle or machine 10 to which handle assembly 200 is mounted and in the most preferred form controls the operative function dependent upon the extent to which the control portion 220 is moved relative to the handle 202. In the preferred form, control portion 220 controls the speed/movement direction of floor scrubber 10 and in the most preferred form controls the speed/movement direction that wheels 16 are driven. Specifically, in the preferred form, when switch 226 is in the neutral position, wheels 16 are not being driven and in the most preferred form are braked, with the electric motor driving the wheels 16 acting as a brake to stop the floor scrubber 10. Further, when switch 226 is in the forward position, wheels 16 are driven to propel floor scrubber 10 in a forward direction, with the speed that wheels 16 are driven being greater with increasing movement from the neutral position toward the forward position. Likewise, when switch 226 is in the reverse position, wheels 16 are driven to propel floor scrubber 10 in a reverse direction, with the speed that wheels 16 are driven being greater with increasing movement from the neutral position towards the rearward position. In the most preferred form, control portion 220 further includes potentiometer 228 which can adjustably control the rate of speed that wheels 16 are driven by pivotal movement of control portion 220 and the maximum rate of speed when in the forward or reverse position. It should be appreciated that potentiometer 228 can be placed at other locations including mounted directly to chassis 12, with its location on control portion 220 believed to be advantageous for accessibility to the operator during operation.

In operation, the operator grips rigid handle 202 preferably by both hands at spaced locations thereon and in the preferred form grips grip bar 204 and/or 206 and most preferably grip bars 206 by wrapping the operator's fingers concentrically around bars 204 and/or 206 and/or the radiused interconnections between bars 204 and 206 in axially spaced positions therearound. It can be appreciated that handle 202 can be gripped by only a single hand of the operator which in that instance should be located generally centrally of gripping bar 204. The operator can control the travel direction of scrubber 10 by applying different amounts and directions of force upon opposite sides of handle 202 to affect the desired line or course of travel. Simultaneously, the palms and/or thumbs of the operator's hands gripping handle 202 can push control portion 220 forward to pivot control portion 220 relative to handle 202 and chassis 12.

Although described as controlling the speed and movement direction of wheels 16, control portion 220 could be utilized for controlling other functions of the walk-behind mobile vehicle or machine 10 according to the teachings of the present invention. As an example, the speed and/or pressure at which scrubbing member 64 engages the floor could be controlled utilizing handle assembly 200 according to the teachings of the present invention. In this regard, the scrubbing member 64 could be utilized for propelling the floor scrubber 10 (especially when of disk brush type). Likewise, handle assembly 200 could include a function switch for allowing control portion 220 to control different functions of the walk-behind mobile vehicle or machine 10. As an example, with such function switch in a first position, control portion 220 could control the speed and movement direction, while in a second position, control portion 220 could control the speed, positioning, or other function of an accessory carried by the walk-behind mobile vehicle or machine 10 such as while in a stationary or standing position.

Although shown and described as a floor scrubber, walk-behind mobile vehicle or machine 10 could have other forms according to the teachings of the present invention including but not limited to turf equipment such as lawn mowers, delivery carts, lifts and the like.

Furthermore, although handle 202 as shown and described is formed as a single member and is preferred and believed to produce synergistic results, handle 202 according to the teachings of the present invention could take other forms and types including U-shaped members of different shapes and/or sizes, individual members on opposite sides or a single member in the center of walk-behind mobile vehicle or machine 10, motorcycle type grip members, or the like. In like manner, although central portion 220 is shown as a single member formed by housings 222 and 224 defining a hollow interior in which switch 226 and potentiometer 228 are carried and located intermediate grip bars 206 and below grip bar 204, control portion 220 according to the teachings of the present invention could have other forms including but not limited to one or more solid toggles for switch 226 mounted on chassis 12, or the like. Furthermore, although shown as being pivotally mounted, control portion 220 could be mounted for other types of movement including but not limited to mounted on linear bearings for movement in a straight or arched line.

Handle assembly 200 according to the preferred teachings of the present invention includes a flexible extension 238 extending between handle 202 and control portion 220 and in the preferred form extending over the separation between handle 202 and control portion 220. In the most preferred form, extension 238 is fixed to control portion 220 and extends generally parallel to and spaced from the plane defined by grip bars 204 and 206 and by handle 202. In the preferred form shown, extension 238 is generally U-shaped and extends along the horizontal upper edge and vertical side edges of rear housing 222. Extension 238 is suitably fixed to rear housing 222 such as by being molded in place on previously fabricated housing 222. However, other manners of fixation including but not limited to the use of adhesive or the like can be utilized. The reason extension 238 is formed separately from housing 222 in the form shown is to allow use of different materials in forming extension 238 and housing 222, with housing 222 being rigid while extension 238 is flexible. However, other manners may exist to form housing 222 and extension 238 as a single piece or as separate pieces able to achieve the characteristics necessary to practice the present invention.

In the most preferred form, extension 238 includes first and second flexible ears or flaps 240 extending from the side vertical edges of rear housing 222 and a third flexible ear or flap 242 extending from the upper horizontal edge of rear housing 222. In the form shown, flaps 240 and 242 are separated from each other such that first and second gaps 244 are formed between flap 242 and flaps 240 at locations corresponding to the interconnections of horizontal grip bar 204 with vertical grip bars 206, with the first and second gaps 244 located on opposite ends of flap 242. Gaps 244 have a size corresponding to the radius of the interconnections between grip bars 204 and 206.

Flaps 240 and 242 according to the present invention have a rigidity substantially less than handle 202 and control portion 220. However, flaps 240 and 242 have a sufficient stiffness to retain their shape when not subjected to an external force, sufficient rigidity to prevent collapsing when an external force required to move control portion 220 relative to handle 202 is applied thereto while having sufficient flexibility to prevent a finger or to other portion of the operator's hand from being detrimentally pinched between flaps 240 and 242 and handle 202. Any section along the free edges of flaps 240 and 242 of the preferred form as shown and described may flex approximately ⅜ inch (0.95 cm) when a point force of 5 pounds (2.3 kg.) is applied near the free edge of a flap 240 or 242 in the form shown. These characteristics can be obtained in a variety of manners and in the preferred form is obtained by a combination of material hardness, material thickness and the cantilever flap length. Specifically, in the most preferred form, extension 238 is formed from molded thermoplastic polyurethane elastomer having a hardness of 57 Shore A durometer, tensile strength of 1200 psi (84.4 metric atmospheres) and elongation of 700%. However, it is believed that other materials may work equally well.

In the most preferred form, flaps 240 and 242 have a decreasing thickness toward their free edges. In particular, flaps 240 and 242 of the form shown have a thickness at the interconnection to housing 222 generally in the order of ⅜ inch (0.95 cm) and taper to a thickness of 3/16 inch (0.48 cm) at their free edges.

In the preferred form shown, the free edges of flaps 240 are linearly straight and are arranged parallel to vertical grip bars 206. In the preferred form shown, the free edge of flap 242 is not linearly straight but is arch-shaped with the center of the arch having the greatest cantilever length of the arch located centrally of horizontal grip bar 204. In the most preferred form, the cantilever length of flaps 240 and 242 are 1.25 inch (3.2 cm) to 2 inches (5.1 cm). In the preferred form shown, flaps 240 and 242 and extension 238 in the neutral position are positioned generally in a plane that is parallel to the plane defined by grip bars 204 and 206 and by handle 202 and having a spacing therefrom in the order of 1 inch (2.5 cm) rearward of handle 202. The free edges of flaps 240 and 242 in the neutral position correspond to the centerline of the grip bars 206 and 204, respectively. In the forward position, the free edges of flaps 240 and 242 in an unflexed condition are spaced from grip bars 204 and 206 in the order of 3/16 inch (0.19 cm).

In operation, an operator grips handle 202 preferably with two hands, with the fingers of the operator extending around grip bars 204 and 206 and/or the interconnections therebetween. While gripping handle 202 with the operator's fingers, extension 238 can be pushed utilizing the palms and/or thumbs of the operator's hands. Pushing of extension 238 results in moving control portion 220, which in the preferred form, in turn results in control portion 220 pivoting about switch bar 208 to actuate switch 226, with the degree of movement variably actuating switch 226. In the most preferred form, pushing of extension 238 into the forward position results in flaps 240 and 242 flexing and engaging the grip bars 204 and/or 206 giving the operator a firm grip on the grip bars 204 and 206 and extension 238 such that the operator can steer floor scrubber 10 and operate variable switch 226 without experiencing the hand fatigue experienced in conventional floor scrubbers. Further, in the preferred form control portion 202 abuts with the physical stops at the forward position before flaps 240 and 242 bottom out at handle 202. Such an arrangement allows a firm grip of handle 202 without overstressing components in control portion 202 which could result if control portion 202 were pushed too hard resulting in bending or breaking of components of control portion 202.

Gaps 244 allow the fingers of the hands of the operator to be wrapped around and grip vertical bars 206 with the thumbs extending over the upper edges of flaps 240 such that extension 238 can be easily pushed with the palms of the hands in the preferred form shown. It should be appreciated that if a finger or other portion of the operator's hands should be located in the path of flaps 240 and 242, flaps 240 and 242 will flex away from handle 202 to prevent detrimentally pinching of such finger or other portion of the operator's hands therebetween. The fingers of the operator can be extended into the spacing between extension 238 and handle 202 in the neutral position and pushed against the forward side of flaps 240 and 242 to move control portion 220 rearward towards and into the reverse position.

Although extension 238 is attached to control portion 220 and extends over handle 202 in the form shown, extension 238 could be attached to handle 202 and extend over control portion 220 according to the teachings of the present invention.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. Control handle assembly for a walk-behind mobile machine comprising, in combination: a rigid handle adapted to be mounted to the walk-behind mobile machine, with the rigid handle being graspable by an operator's hands for steering the walk-behind mobile machine; a control portion movably mounted relative to the rigid handle and defining a separation between the rigid handle and the control portion, with the control portion controlling an operative function of the walk-behind mobile machine, with the control portion being moveable by the operator's hands while grasping the rigid handle, with the control portion having a rigidity; and an extension extending between the rigid handle and the control portion and over the separation, with the extension formed of flexible material having a rigidity less than the rigid handle and the control portion to allow flexing if a finger of the operator's hand is extended into the separation and if the extension simultaneously engages the rigid handle and control portion during movement of the control portion relative to the rigid handle.

2. The control handle assembly of claim 1 with the rigid handle including right and left grip bars for grasping by right and left hands of the operator.

3. The control handle assembly of claim 2 with the control portion located between the right and left grip bars, with the separation being formed between the control portion and the right grip bar and between the control portion and the left grip.

4. The control handle assembly of claim 3 with the rigid handle further including a connection grip bar extending between and secured to the right and left grip bars.

5. The control handle assembly of claim 4 with the separation being formed between the control portion and the connection grip bar.

6. The control handle assembly of claim 5 with the control portion including right, left and central flexible ears, with the right flexible ear extending between the right grip bar and the control portion and over the separation therebetween, with the left flexible ear extending between the left grip bar and the control portion and over the separation therebetween, with the central flexible ear extending between the connection grip bar and the control portion and over the separation therebetween.

7. The control handle assembly of claim 6 with gaps formed between the right flexible ear and the central flexible ear and between the left flexible ear and the central flexible ear.

8. The control handle assembly of claim 7 with the extension being generally U-shaped with the right flexible ear connected to an end of the central flexible ear and the left flexible ear connected to an opposite end of the central flexible ear.

9. The control handle assembly of claim 8 with the control portion being pivotably mounted.

10. The control handle assembly of claim 9 with the rigid handle further including a switch bar extending between and secured to the right and left grip bars, with the control portion being pivotably mounted to the switch bar.

11. The control handle assembly of claim 10 with the control portion including a rear housing and a front housing secured together to define a hollow interior.

12. The control handle assembly of claim 11 with the extension secured to and moveable with the control portion.

13. The control handle assembly of claim 12 with the control portion moveable between a neutral position and a forward position, with the extension spaced from the rigid handle in the neutral position and engaging with the rigid handle in a flexed condition in the forward position.

14. The control handle assembly of claim 13 with the control portion including a variable switch providing a variable signal according to movement between the neutral position and the forward position.

15. The control handle assembly of claim 2 with the rigid handle further including a connection grip bar extending between and secured to the right and left grip bars.

16. The control handle assembly of claim 15 with the control portion being pivotably mounted.

17. The control handle assembly of claim 2 with the control portion being pivotally mounted and being formed as a single member located between the right and left grip bars and engageable by either or both of the right and left hands of the operator located on the right and left grip bars.

18. The control handle assembly of claim 1 with the rigid handle including a switch bar, with the walk-behind machine moveable in an operating direction, with the switch bar extending generally perpendicular to the operating direction, with the switch bar being connected to the walk-behind mobile machine, with the control portion being pivotably mounted to the switch bar.

19. The control handle assembly of claim 1 with the control portion being pivotably mounted.

20. The control handle assembly of claim 19 with the control portion being pivotally mounted on the rigid handle.

* * * * *